United States Patent [19]

Inoue et al.

[11] 4,237,212

[45] Dec. 2, 1980

[54] PROCESS FOR FORMING IMAGES

[75] Inventors: Eiichi Inoue, Tokyo; Misturu Takeda, Machida; Fumio Shimada, Tokyo, all of Japan

[73] Assignee: Dai Nippon Insatu Kabushiki Kaisha, Tokyo, Japan

[21] Appl. No.: 11,849

[22] Filed: Feb. 13, 1979

Related U.S. Application Data

[63] Continuation-in-part of Ser. No. 825,109, Aug. 16, 1977, abandoned.

[30] Foreign Application Priority Data

Aug. 17, 1976 [JP] Japan ..... 51-97468

[51] Int. Cl.[3] ..... G03C 5/24

[52] U.S. Cl. ..... 430/346; 430/353; 430/428; 430/495; 430/944; 430/931

[58] Field of Search ..... 430/944; 96/48 R, 45.2, 96/88, 90 PC; 427/144, 145; 428/913; 430/346, 353, 428, 495, 944, 931

[56] References Cited

U.S. PATENT DOCUMENTS

| | | | |
|---|---|---|---|
| 2,427,443 | 9/1947 | Cochran | 96/88 |
| 2,980,551 | 4/1961 | Thomsen | 427/144 |
| 3,028,255 | 4/1962 | Owen | 428/913 |
| 3,152,902 | 10/1964 | Jacobs | 96/45.2 |
| 3,166,433 | 1/1965 | Baumann et al. | 428/913 |
| 3,236,651 | 2/1966 | Marks | 96/90 PC |
| 3,285,746 | 11/1966 | Marks et al. | 96/90 PC |
| 3,712,817 | 1/1973 | Hazy | 96/45.2 |

FOREIGN PATENT DOCUMENTS

| | | | |
|---|---|---|---|
| 1008536 | 10/1965 | United Kingdom | 96/90 PC |
| 1008537 | 10/1965 | United Kingdom | 96/90 PC |

*Primary Examiner*—Won H. Louie, Jr.
*Attorney, Agent, or Firm*—Koda and Androlia

[57] ABSTRACT

An image-forming agent selected from polyacids of molybdenum and tungsten and salts and complexes of these polyacids and disposed as a layer on at least one surface of a support substrate is reduced thereby being caused to undergo coloring in the form of an image and is then irradiated over its entire surface including thus colored parts and yet uncolored parts with long wavelength light rays which are absorbable by only the colored parts thereby to produce a colored image wherein the optical density of only the colored parts is selectively increased to a remarkable degree.

12 Claims, 4 Drawing Figures

PROCESS FOR FORMING IMAGES

CROSS REFERENCE TO RELATED APPLICATION

This application is a continuation-in-part of application Ser. No. 825,109, filed Aug. 16, 1977, now abandoned.

BACKGROUND OF THE INVENTION

This invention relates generally to techniques in forming visible pictures or images through the use of so-called nonsilver photosensitive materials or photosensitive materials comprising compounds other than silver salts. More particularly, the invention relates to a process for forming visible pictures or images (hereinafter referred to as "images") of excellent contrast with high sensitivity by treating an image forming agent comprising a polyacid of molybdenum or tungsten or its salts or complex and relates also to an image-forming material for this process.

It is known that heteropolyacids and the like of molybdenum and tungsten as mentioned above, such as phosphomolybdic acid, for example, are reduced by light or heat to develop colors ranging from blue to black. Furthermore, attempts have been and are being made to utilize this phenomenon for formation of images through the use of flash light. One known technique for this purpose comprises placing on a reflecting original a heat-sensitive material formed by applying phosphomolybdic acid, for example, as a coating on a transparent substrate and projecting a flash light through this heat-sensitive material to the reflecting original and imparting heat rays from the black parts of the reflecting original as radiant heat to the heat-sensitive material thereby to impart an image to the heat-sensitive material. (U.S. Pat. No. 2,980,551).

In the practice of this method, however, a number of difficulties are encountered. For example, the resolution or resolving power decreases because of heat diffusion toward the periphery of the image, and only materials which are transparent and, moreover, have low heat conductivity can be used for the support.

In addition, the specifications of British Pat. No. 1,008,537 and U.S. Pat. No. 3,285,746 both disclose the projecting of intense light rays having an energy exceeding a certain threshold value onto a film consisting of a solid solution comprising a polyacid such as phosphomolybdic acid or silicotungstic acid and a polyvinyl alcohol/acetate copolymer or polyvinyl butyral thereby to cause the film to become opaque. From the teaching of these patented inventions, it is understand that the above mentioned material can be used as a photographic material capable of producing an image when irradiated by intense, image-wise light rays. However, since it is necessary to project continuously image light rays of a high intensity required for this process (i.e., because of low sensitivity), the utility of the material as a photographic material must be judged to be low.

As a result of our studies on the coloring or color-developing phenomenon of compounds such as phosphomolybdic acid, we have discovered that this coloring includes two process stages.

More specifically, in the first stage, phosphomolybdic acid or the like is reduced and temporarily undergoes a weak coloring. In the case where this coloring is extremely weak, the image may be a latent image. This primary coloring is attained by the reduction of phosphomolybdic acid or the like as was known heretofore, and for this purpose, a method of irradiating with ultraviolet rays the phosphomolybdic acid coexisting with a reducing agetn or a method of bringing a reducing agent in contact with the phosphomolybdic acid, can be resorted to.

In the second stage, the phosphomolybdic acid which has undergone the above described primary coloring further absorbs light and becomes of dark or black color. A noteworthy point is that this second stage cannot be caused to progress by irradiation with only ultraviolet rays but can be caused to progress only by using light rays having wavelengths longer than the ultraviolet region (visible and infrared rays). While light having a long wavelength of this character has a color darkening effect with respect to phosphomolybdic acid which has undergone the primary coloring, it has no effect whatsoever on phosphomolybdic acid which has not undergone the primary coloring. This property of phosphomolybdic acid is not limited to only this acid but is common to polyacids of molybdenum and tungsten and to salts and complexes thereof as described hereinafter.

On the basis of the above findings, we have carried out further studies. As a result, we have developed an image-forming process of high sensitivity through the use of nonsilver materials and an improved photosensitive material suitable for use in this process.

SUMMARY OF THE INVENTION

According to this invention in one aspect thereof, briefly summarized, there is provide an image-forming process characterized by the steps of (1) reducing in the form of an image and thus causing to undergo coloring an image-forming agent selected from polyacids of molybdenum and tungsten and salts and complexes of these polyacids and provided in layer form on at least one surface of a substrate and (2) irradiating the entire expanse of the image-forming agent surface thus obtained and including colored parts and yet uncolored parts with long wavelength light rays which are absorbable by only the colored parts thereby to produce a colored image wherein the optical density of only the colored parts is selectively increased to a remarkable degree. The image in most cases is a black image but images of brown or other tones are possible depending on the image-forming agent. These images are hereinafter represented by the term "black image".

By the practice of the image-forming process of this invention, the coloring process step (i.e., the first process step) of coloring in the form of the image, which determines the sensitivity of the finished image-forming material, is remarkably simplified. In the case where this step is carried out by irradiation with light, only an extremely small quantity of exposure is sufficient (this quantity differing with the composition but being of the order of 100 mJ/cm$^2$. for satisfactory results).

As the succeeding step, the entire expanse of the image-forming agent surface including the primarily colored image parts is irradiated with long wavelength light rays to which the yet uncolored parts are not sensitive, whereupon the image parts only are selectively rendered black. That is, in the second process step, a contrast similar to that due to exposure to image pattern light rays is obtained by merely carrying out entire surface irradiation without resorting to controled exposure to image-wise light rays. This means that the entire surface irradiation with the long wavelength light rays has not only a mere developing action but also, as an effective result, an effect of increasing the sensitivity of the image-forming agent. Therefore, when a structure comprising a substrate and this image-forming agent applied thereon as a coating is used as a photographic material, the second process step can be completely separated from the first process step, and this structure becomes a material of extremely high sensitivity for imparting contrast after the second process step with only the quantity of image-wise exposure of the first process step.

In accordance with this invention, furthermore, the material of the substrate is not limited, and after the image-forming material has been once formed, it is possible to operate the entire image-forming process without any wet treatment, thereby a black image of excellent resolution can be advantageously obtained.

According to this invention in another aspect thereof, there is provided a further improved nonsilver photosensitive material. In a conventional photosensitive material comprising a substrate and an image-forming agent layer of a substance such as a polyacid of molybdenum or tungsten provided as a layer on at least one surface of the substrate color-change of the image-forming agent is caused by the absorption of a considerable quantity of heat, irrespective of whether it is applied in one stage or whether it is applied in two stages. For this reason, this absorbed heat gives rise to undesirable results such as the occurrence of cracks and pin holes in the surface of the image-forming agent layer, pulverization of the layer, and spreading by oozing of the black parts into the non-image parts. These defects give rise to a lowering of the resolution of the image and a lowering of the preservability or durability of the image, and it is desirable that they be eliminated for practical purposes.

As a result of our studies, however, we have found that, by providing a film of a transparent polymer substance on the image-forming agent layer, all of these defects can be eliminated, and, moreover, the preservation stability of the finished photosensitive or image forming material itself is also improved.

More specifically, according to this invention, there is provided an improved image-forming material comprising:

- a substrate;
- an image-forming layer provided on at least one surface of the substrate and comprising an image-forming agent selected from polyacids of molybdenum and tungsten and salts and complexes of these polyacids; and
- a transparent polymer film provided on the image-forming layer,
- at least one of the image-forming layer and the transparent polymer film containing a reducing agent.

The nature, utility, and further features of this invention will be more clearly apparent from the following detailed description, beginning with a consideration of general aspects and details of the invention and concluding with specific examples of practice illustrating preferred embodiments of the invention.

DETAILED DESCRIPTION

Figure 1:
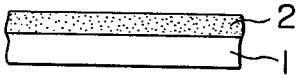
FIG. 1 is a fragmentary, enlarged sectional view showing an example of a basic photosensitive material which can be used according to this invention.

The image-forming process of this invention can be practiced through the use of an image-forming photosensitive material having a construction basically as shown in FIG. 1. This material comprises a substrate 1 and an image-forming agent layer 2, which may contain, in addition to the image-forming agent, a binder and/or a reducing agent.

Figure 2:
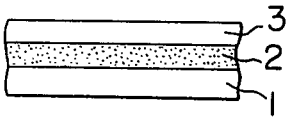
FIG. 2 is a similar sectional view showing one example of an improved photosensitive material of the invention.

The basic construction of an improved image-forming material of the invention is shown in FIG. 2. This material is formed by providing a transparent polymer film 3 on the outer surface of the image-forming agent layer 2 of the image-forming material illustrated in FIG. 1. In this case, a reducing agent is contained in at least one of the image-forming agent layer 2 and the transparent polymer film 3.

The substrate 1 may be of any suitable material such as paper, plastic sheet, glass, metal, or the like and be of any suitable shape provided that it has at least one surface.

For the image-forming agent in the practice of this invention, one or more members selected from the group consisting of polyacids (isopolyacids and heteropolyacids) of molybdenum and tungsten and salts (preferably alkali metal salts and ammonium salts) and complexes of these acids can be used. Specific examples of these suitable image-forming agents are molybdic acid, sodium molybdate, ammonium molybdate, phosphomolybdic acid, ammonium phosphomolybdate, silicomolybdic acid, ammonium silicomolybdate, arsenomolybdic acid, ammonium arsenomolybdate, sodium arsenomolybdate, tungstic acid, ammonium tungstate, phosphotungstic acid, ammonium phosphotungstate, silicotungstic acid, ammonium silicotungstate, sodium silicotungstate, arsenotungstic acid, ammonium arsenotungstate, and sodium arsenotungstate.

In addition, compounds such as complexes with amines such as isopropylammonium molydate and complexes with other metals such as phosphovanadomolybdic acid can also be used.

While the above mentioned molybdic acid, tungstic acid, and salts thereof are used with the intention of not including the ortho-acid and salts thereof, the ortho-acid and salts thereof can be considered as being included in the primary starting material since they exist as an isopolyacid or a salt thereof in an acidic condition.

Ordinarily, an image-forming agent of this character is applied as coating as an aqueous or alcohol solution together with a binder or additionally with a reducing agent as described hereinafter on the substrate 1, and, after drying thereof, the image-forming layer 2 is formed. Accordingly, a polymer compound which is soluble in water or an alcohol such as, for example, gelatin, polyvinyl alcohol, polyvinyl butyral, and cellulose esters are preferably used for the binder. However, other film-forming polymers are capable of being applied as coating in a dispersed state in the presence of a suitable emulsifier.

In addition to water and alcohols, solvents which are capable of dissolving the image-forming agent, such as acetone, methyl ethyl ketone, and dimethylformamide, can be used.

Examples of reducing agents which can be used according to this invention are organic reducing agents including: D-glucose, thiourea, oxalato iron, Micheler's ketone, L-ascorbic acid, diphenylamine, diphenylcarbazide, and polymers such as polyvinyl alcohol, polyvinyl acetate, and polyvinyl butyral; and inorganic reducing agents including titanium oxide, zinc oxide, tin chloride, and metals such as lead, tin, iron, and zinc. The reducing agent, however, is not limited to the above enumerated compounds but may be any suitable substance provided that it exhibits a reducing effect with respect to the above described image-forming agent.

Of these reducing agents, those of weak reducing capability such as D-glucose and polymers do not give rise to coloring by merely coexisting with the image-forming agent. Accordingly, these reducing agents can be left in mixed state in the image-forming layer 2. Furthermore, these polymer compounds can possess additionally the effect of the above mentioned binder.

Of the polymers, those such as nitrocellulose do not, themselves, have a reducing effect while they may be used as a binder. With respect to a specific polymer or the like, the determination of whether or not it possesses the desired reducing effect can be made in the following manner. A film (of a thickness of approximately 10 micron) obtained with a weight ratio of 1 of the test substance to 2 of phosphomolybdic acid is provided on a polyester film which is of non-reducing character and is irradiated for 1 hour with ultraviolet rays from a distance of 20 cm. by a 250-watt mercury lamp. In the case where the difference of the Macbeth optical diffusion transmission concentrations of the film before and after the irradiation exceeds 0.01, this test substance can be used as a reducing agent according to this invention.

On the other hand, when strongly reducing substances such as thiourea, oxaloto iron, L-ascorbic acid, diphenylamine, diphenylcarbazide, and Micheler's ketone are caused to be contained in the image-forming layer 2, they become a cause of fogging. Accordingly, when these strongly reducing substances are to be contained in the image-forming material structure, it is preferable that they be contained in the polymer film (hereinafter referred to as "over-coat layer") 3.

For the polymer to be used for forming the over-coat layer 3 in the improved image-forming material, any material which is transparent and can be applied as a coating can be used. In the case where a polymer which is soluble in water or an alcohol is used as a binder of the image-forming layer 2, it is desirable that a polymer which is insoluble in water or an alcohol be used for this over-coat layer forming polymer. The reason for this is to prevent dissolution of the image-forming layer 2 once formed and disturbance of the interface between the image forming layer 2 and the over-coat layer 3 in the application of the over-coat layer forming polymer in the form of a solution. In many cases, the image is formed in the image-forming layer 2 in the vicinity of the interface between it and the over-coat layer 3, and the prevention of disturbance of the interface is important for increasing the resolving power.

A further reason is that when a solvent capable of dissolving the image-forming layer is used for the purpose of forming the over-coat layer, and a strong reducing agent is contained in this solution, dissolving of the image-forming occurs and, simultaneously, coloring is caused upon application of the solution on the image-forming layer. Examples of preferred over-coat layer forming polymers are polyvinyl chloride resins, polyvinyl acetate resins, polyvinylidene chloride resins, cellulose resins, polystyrene, polypropylene, polyvinyl carbazole, methacrylic resins, polyamide resins, polyurethane resins, fluorine resins, and rubber chlorides. Polyvinyl chloride resins and polyvinylidene chloride resins function also as reducing agents.

A representative process for producing image-forming materials on the basis of the above described starting materials will now be described.

First, the image-forming agent is dissolved in water or an alcohol, and, depending on the necessity, a binder and/or a weak reducing agent are/is further dissolved in the solvent. The solution thus obtained is applied as a coating on the substrate 1 and dried in air thereby to form the image-forming layer 2.

In the case where a paper possessing permeability is used for the substrate 1, it can function additionally to have a reducing effect and the effect of a binder. For this reason, the combined structure of the substrate 1 and the image-forming layer 2 of this invention can be produced by applying image-forming agent directly without using an additional binder and/or reducing agent.

However, the use of a binder in the solution of the above mentioned image-forming agent is preferable for image formation and for coating characteristic of the solution. When a binder is used, it is preferable that its concentration be such that the image-forming agent concentration in the image-forming layer in the dry state will be greater than 15 percent by weight in order to impart a high optical density to the image. Furthermore, it is preferable, in order to maintain the film characteristic of the image-forming layer in a good state, that the concentration of the binder in the dry state be 10 to 60 percent by weight.

When the image-forming layer 2 is to contain a reducing agent, the quantity in which it is used depends on the reducing power of the reducing agent, but adjustment wherein this quantity is made small for a relatively strong reducing agent and is made somewhat on the greater side for a relatively weak reducing agent is necessary. In any case, the appropriate quantity of the reducing agent is determined within a range wherein the image-forming layer does not undergo substantial coloring when irradiated with light rays not containing ultraviolet rays.

For example, when D-glucose, which is a relatively weak reducing agent, is used in combination with a phosphomolybdic acid, image-forming agent, a D-glucose concentration in the image-forming layer in dry state of 5 to 50 percent by weight is suitable.

Furthermore, when the reducing agent functions additionally as a binder as in the case of the above mentioned polymer reducing agents, the above set forth concentration range of the binder can be applied directly as it is.

A thickness of the image-forming layer 2 on the substrate 1 of the order of 2 to 20 microns is desirable. When this thickness is less than 2 microns, the image density is slightly deficient. On the other hand, when this thickness exceeds 20 microns, the density prior to exposure to light (therefore the density of the non-image parts) increases, and, for this reason, there is a tendency of the contrast of the image to become poor.

Thus, an image-forming material as illustrated in FIG. 1 is obtained.

An improved image-forming material of this invention is produced by applying as a coating the above described over-coat layer forming polymer on the image-forming layer 2 of the image-forming material illustrated in FIG. 1. For this coating, the over-coat layer forming polymer is dissolved preferably in a solvent which will not dissolve the image-forming agent and the binder. For example, in the case where a binder which is soluble in water and alcohols is used in the image-forming layer, the over-coat layer forming polymer is dissolved in an organic solvent of relatively low solubility in water and alcohols such as, for example, benzene, toluene, and tetrahydrofuran, and, depending on the necessity, a reducing agent is additionally admixed, and the resulting mixture is applied as a coating on the image-forming layer 2. In the case where the reducing agent in this process is insoluble in the solvent, the reducing agent is rendered into fine powder and dispersed in the binder solution by the use of means such as an ultrasonic dispersion machine, and then the resulting dispersion is applied as a coating on the image-forming layer 2. The solvent is then evaporated off by drying in a stream of air, whereupon the over-coat layer 3 is obtained.

We have found that a thickness of the over-coat layer 3 of the order of 5 to 15 microns is desirable. With a thickness less than 5 microns, the effect from the image part cannot be neglected, and the effectiveness of the over-coat is deficient. On the other hand, when the thickness exceeds 15 microns, the light absorbing efficiency of the image-forming layer 2 becomes poor, and the sensitivity of the structure as a photosensitive material tends to decrease.

For the application of the solution or dispersion of the above described image-forming agent on the substrate or the over-coat layer forming agent, any of the conventional methods such as bar coating, roll coating, wheeler coating, dip coating, and spray coating can be used.

The improved image-forming material of the invention produced in the above described manner can assume the following three dispositions of the reducing agent depending on its presence in the image-forming layer 2 and the over-coat layer 3.

(a) The case where the reducing agent is contained in the over-coat layer 3.

(b) The case where the reducing agent is contained in the image-forming layer 2.

(c) The case where the reducing agent is contained in both the over-coat layer 3 and the image-forming layer 2.

In each of the above three cases, the improved image-forming material of the invention fully exhibits the aforementioned highly desirable characteristics. That is, the occurrences of various defects such as cracks and pin holes in the surface of the image-forming layer 2, pulverization of the surface, and oozing of the image parts into the non-image parts are effectively eliminated, and other effects such as an improvement in the resolution of the image and the preservability of the image and an improvement in the preservation stability prior to use are attained.

However, differences are observed on the following points. The above case (b) corresponds to a structure wherein an over-coat layer is provided on an image-forming layer of a conventional photosensitive material, but, for equal reducing power of the reducing agent, the sensitivity in the case (a) is slightly lower than that in this case (b). However, the case (a) is advantageous in that a strong reducing agent can be used therein and is superior in preventing fogging. In this case, furthermore there is a great advantage in that, by forming an over-coat layer containing the reducing agent a short time before the use of the photosensitive material, the preservability of the image-forming material can be remarkably improved. On one hand, the sensitivity in the case (c) rises to approximately twice that in the case (b).

The photosensitive material of this invention obtained in the above described manner can be used in the one-stage method. That is, by irradiating the photo-sensitive material of this invention with image-wise light rays including ultraviolet and visible and/or infrared rays with more than a specific quantity of energy (e.g., 5 J/cm$^2$), the desired image coloring can be obtained.

However, as mentioned hereinbefore, since the sensitivity of the above mentioned process relative to image-wise irradiation light is low, the use of the image-forming process depending on the aforementioned two-stage method of the invention is preferable even when the improved photosensitive material of this invention is used.

The image-forming process of this invention with the use of the image-forming material obtained in this manner will now be described. This process comprises two process steps.

In the first step, the image-forming agent layer 2 provided on the substrate 1 is reduced image-wise thereby to obtain coloring parts. This coloring can be accomplished by either of two methods. In one of these methods, in the coating of the image-forming agent layer 2 on the substrate 1, the reducing agent is caused to coexist (inclusive of both the cases where the reducing agent is contained in the image-forming agent layer 2 and the case where it is contained in the over-coat layer 3), and the surface of the image-forming layer 2 on the support 1 thus obtained is irradiated with image-wise ultraviolet rays. In the other coloring method, the reducing agent is caused to contact directly and image-wise, the image-forming agent surface 2 on the substrate 1. Of the reducing agents enumerated hereinbefore, a strong reducing agent such as tin chloride, for example, is dissolved in a solvent such as water, and, depending on the necessity, a binder is added to effect transformation into ink, which is sprayed by the ink-jet method onto the required image parts. By this procedure, reduction coloring in the image form is obtained on the image-forming agent surface 2 of an image-forming material as illustrated in FIG. 1.

The first coloring method is a particularly interesting method, and, while the use of the image-forming material shown in FIG. 2 is preferable, it is possible to use the material illustrated in FIG. 1.

Figure 3:
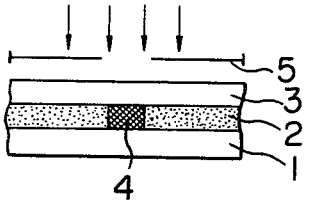
FIGS. 3 and 4 are similar sectional views for a description of image formation according to a two-stage process of this invention.

As indicated in FIG. 3 illustrating the case where the image-forming material shown in FIG. 2 is used, image-wise ultraviolet rays are projected through the over-coat layer 3 of the photosensitive material onto the outer surface of the image-forming layer 2 (or the interface between the layer 2 and the over-coat layer 3, which interface or the outer surface will hereinafter be referred to as "image-forming surface"). With an irradiation energy of the order of 100 mJ/cm$^2$., a primary coloring part 4 of light blue color of the image pattern is obtained on the image-forming surface.

The term "ultraviolet rays" is used herein to designate light rays which include light of the wavelength of the ultraviolet region, and which may include additionally visible light and infrared light. For the light source to emit the image-wise ultraviolet rays, a mercury lamp, an xenon flash, a laser beam, and other sources can be used. By passing these ultraviolet rays through a transmission original 5, image-wise ultraviolet rays can be obtained. Laser light can be projected image-wise as a direct beam. Furthermore, ordinary camera photography is also possible, but in this case, of course, it is necessary that the irradiation light to be projected onto the objective be ultraviolet rays.

Figure 4:
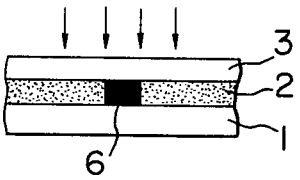

Then, in the second process step, the entire image-forming surface including the colored parts and yet uncolored parts obtained in the above described manner is irradiated with light rays of long wavelength which cannot be sensed by the yet uncolored parts thereby to render only the above mentioned colored parts selectively into black or dark color and thereby to obtain the image part 6. While the case where the image-forming material illustrated in FIG. 2 is indicated in FIGS. 3 and 4, the same description as set forth above, except for the absence of the overcoat layer 3, applies also in the case where the material shown in FIG. 1 is used.

It is necessary that the above mentioned long wavelength light rays be those which result after light rays of short wavelengths such as to be absorbed by the yet uncolored parts are selectively cut off. The critical wavelength satisfying the conditions of being absorbed only by the colored parts and not being absorbed by the yet uncolored parts differs with the various combinations of the image-forming agent and the reducing agent, but it has been found that, generally, this critical wavelength is in the vicinity of the boundary between the visible light region and the ultraviolet light region. This long wavelength light can be obtained by passing the light from a light source such as a xenon lamp, a tungsten lamp, a xenon flash, or a laser device through a filter cutting off ultraviolet rays.

By the irradiation at this stage, the densities of the colored parts increase with increase in the quantity of light absorbed by these parts, which thus reach colors close to jet black, but the non-colored parts undergo almost no variation. Accordingly, the exposure at this stage can be selected within any range in accordance with the required contrast, but even with an exposure of minimum of the order of 2.5 $J/cm^2$., a satisfactory contrast can be obtained.

The black image thus obtained has a contrast of a degree of clarity which could not be attained with a conventional nonsilver photosensitive material. Even when it is left naturally, this material exhibits semipermanency in undergoing no color change, and the non-image parts also do not assume a black color. However, in order to leave an image which is stable with respect to even heating and ultraviolet light, it is preferable to carry out fixing treatment. More specifically, in accordance with this invention, the uncolored image-forming agent remaining in the non-image parts can be caused to lose its image-forming capability by treating it with an alkaline substance such as ammonia gas, ammonia water, or an aqueous solution of sodium hydroxide. As a result, an image which has been subjected to this alkali treatment has a high contrast, and the material is characterized in that the non-image parts is not caused to change color even by heating.

Another noteworthy feature is that this alkali treatment is effective not only after the formation of the black image but also when applied to the entire surface of the image-forming agent after the primary coloring. More specifically, when the surface of the image-forming agent after the primary coloring is treated with a suitable concentration of alkali for a suitable time (e.g. 2–3 secs. in $NH_3$ gas), the uncolored parts lose their image-forming capability, but the image parts which have once been colored do not lose their capability of turning black and are selectively rendered black by irradiation with long wavelength light rays.

The above described image-forming process and material according to this invention can be advantageously applied to systems such as rapid reproduction systems, projection image preparing systems, and IC mask material preparing systems. By such application the operational characteristics of these systems are remarkably improved because of advantages such as high image density, high resolving power and sensitivity, and good preservation stability of the image-forming material prior to and after exposure.

The image obtained by the process of the present invention without the alkaline treatment mentioned hereinabove is stable in natural light which is free of ultraviolet rays and does not fade when exposed to natural light. The above mentioned fixing step of exposing the image thus obtained to an alkaline substance is optional but maybe desirable because it makes the image stable even in light which includes ultraviolet rays and infrared rays.

In order to indicate more fully the nature and utility of this invention, the following examples of practice constituting preferred embodiments of the invention are set forth, it being understood that these examples are present as illustrative only and that they are not intended to limit the scope of the invention. Throughout the following examples, quantities expressed in "parts" and "percent" (%) are by weight.

EXAMPLE 1

One part of phosphomolybdic acid was dissolved in 5 parts of a 10-percent aqueous solution of polyvinyl alcohol, and the resulting solution was applied by means of a wire bar on a polyester film, whereupon a photosensitive structure having an image-forming agent layer of 8-micron thickness was obtained.

A transmisson original was placed in direct contact with the photosensitive structure thus obtained, which, through the original, was exposed for an exposure time of 10 seconds to a 500-W, ultrahigh-voltage, mercury-arc lamp at a distance of 30 cm., whereupon an image wherein the exposed parts had become blue was obtained.

The transmission original was then removed, and the entire surface of this exposed photosensitive structure was exposed to light from a xenon flash lamp (RISO-TRAPEN'UP TU-207®, manufactured by Riso Kagaku Sha, Japan) having passed through a filter for cutting off ultraviolet rays (Toshiba AT-V-Y 47). As a result, an image wherein only the blue parts of the image exposed to the ultrahigh-voltage, mercury-arc lamp had become black was obtained.

It was found that the optical transmission density of the image parts had increased remarkably from a density of 0.1 prior to flash exposure to a value of 2.0 after flash exposure. During this period, the transmission density of the non-image parts remained at 0.04.

EXAMPLE 2

One part of phosphomolybdic acid was dissolved in 5 parts of a 10-percent polyvinyl butyral alcohol solution, and the resulting solution was applied as coating on art paper by means of a wire bar, whereupon a photosensitive structure was obtained. By using this photosensitive structure, a black image was obtained by the process set forth in Example 1.

EXAMPLE 3

One part of phosphomolybdic acid and one part of D-glucose were dissolved or dispersed in 5 parts of collodion, and the resulting liquid was used to dip coat a glass substrate or support, whereupon a photosensitive structure was obtained. With the use of this photosensitive structure, a black image was obtained by the process described in Example 1.

EXAMPLE 4

A photosensitive structure was prepared by the process described in Example 1 except for the use of silicomolybdic acid instead of phosphomolybdic acid. By using this photosensitive structure, a black image was obtained by the process set forth in Example 1.

EXAMPLE 5

A photosensitive structure was prepared by the process described in Example 2 except for the use of silicomolybdic acid instead of phosphomolybdic acid. By using this photosensitive structure, a black image was obtained by the process set forth in Example 2.

EXAMPLE 6

By using a photosensitive structure prepared by the process specified in Example 3 except for the use of silicomolybdic acid instead of phosphomolybdic acid, a black image was obtained by the procedure set forth in Example 3.

EXAMPLE 7

One part of phosphotungstic acid was dissolved in 5 parts of a 10-percent polyvinyl butyral alcohol solution, and the resulting solution was applied as a coating on a sheet of art paper by means of a wire bar thereby to prepare a photosensitive structure. This photosensitive structure was exposed to light from a xenon flash lamp (RISŌ TRAPEN' UP TU-207) through a filter for cutting off visible and infrared rays and through a transmission original placed in direct contact with the surface of the photosensitive structure. As a result, an image in which the parts thus exposed were colored was obtained.

The transmission original was then removed, and the entire surface of the photosensitive structure thus exposed to light was exposed to light from a xenon flash lamp through a filter for cutting off ultraviolet rays, whereupon an image wherein blue colored parts has become black was obtained.

EXAMPLE 8

The image obtained in Example 1 was exposed to ammonia gas and was thereby rendered into a stable image which did not change color when subjected to heating.

EXAMPLE 9

The image obtained in Example 2 was immersed in an ammonia solution.

EXAMPLE 10

One part of molybdic acid was dissolved in 5 parts in a 10-percent aqueous solution of polyvinyl alcohol, and the resulting solution was adjusted to the vicinity of pH 2 by adding hydrochloric acid thereto. The solution was then applied as a coating on a polyester film with a wire bar thereby to prepare a photosensitive structure. This photosensitive structure was used to form an image similar as in Example 1, whereupon a brown image was obtained.

EXAMPLE 11

The procedure set forth in Example 10, except for the use of ammonium molybdate instead of molybdic acid and a 10-percent aqueous solution of polyacrylic acid instead of the 10-percent aqueous solution of polyvinyl alcohol, was carried out. As a result a black image was obtained.

EXAMPLE 12

The procedure specified in Example 10, except for the use of isopropylammonium molybdate obtained from the reaction of isopropylamine and ammonium molybdate instead of the molybdic acid, was carried out. As a result a black image was obtained.

EXAMPLE 13

One part of phosphomolybdic acid was dissolved in 5 parts of a 10-percent aqueous solution of of polyvinyl alcohol, and the resulting solution was applied as a coating on a sheet of polyester film with a wire bar and the dried for 5 minutes in an oven at 50° C., whereupon an image-forming layer was obtained. Then, as an over-coat layer, a 5-percent toluene solution of polyvinyl chloride was applied as a coating on this image-forming layer with a wire bar and then dried for 5 minutes in an oven at 50° C. As a result, a photosensitive structure of a thickness of 13 microns (image-forming layer approximately 8 microns, over-coat layer approximately 5 microns).

A transmission original was placed in direct contact with this photosensitive structure, which was then exposed for 10 seconds to light from a 500-watt ultrahigh-voltage mercury lamp at a distance of 30 cm., whereupon an image wherein the exposed parts had become blue. The transmission original was removed, and the entire surface of the photosensitive structure thus exposed was exposed to light from a xenon flash lamp (RISŌ TRANPEN' UP TU-207®) having passed through a filter for cutting off ultraviolet rays (Toshiba AT-V-Y 47). As a result, an image wherein only the blue parts of the image exposed to the ultrahigh-voltage, mercury-arc lamp had become black was obtained.

It was found that the optical transmission density of the image parts had increased remarkably, from a density of 0.1 prior to flash exposure to a value of 2.0 after flash exposure. During this period, the transmission density of the non-image parts remained at 0.04.

EXAMPLE 14

One part of phosphomolybdic acid was dissolved in 5 parts of a 10-percent polyvinyl butyral alcohol solution. The resulting solution was applied as a coating layer on a sheet of art paper with a wire bar and then dried for 5 minutes in an oven at 50° C., whereupon an image-forming layer was obtained on the art paper. On this image-forming layer, a 10-percent toluene solution of ethylcellulose was applied as an over-coat layer thereby to produce a photosensitive structure. By using this photosensitive structure, the procedure set forth in Example 13 was followed, whereupon a black image was produced.

EXAMPLE 15

One part of phosphomolybdic acid was dissolved and dispersed in 5 parts of a collodion solution, and the resulting solution was applied by dip coating onto a glass substrate to obtain an image-forming layer. Onto this image-forming layer, a 5-percent polyvinylidene chloride THF solution was applied as a coating layer and dried for 5 minutes in an oven at 50° C. to produce a photosensitive structure. With the use of this photosensitive structure a black image was obtained by the process set forth in Example 13.

EXAMPLE 16

A photosensitive structure obtained as in Example 13 except for the use of silicomolybdic acid instead of phosphomolybdic acid was used similarly as in Example 13 to produce a black image.

EXAMPLE 17

A photosensitive structure obtained as in Example 14 except for the use of silicomolybdic acid instead of phosphomolybdic acid was used similarly as in Example 14 to produce a black image.

EXAMPLE 18

A photosensitive structure obtained as in Example 15 except for the use of silicomolybdic acid instead of phosphomolybdic acid was used similarly as in Example 15 to produce a black image.

EXAMPLE 19

One part of phosphotungstic acid was dissolved in 5 parts of a 10-percent polyvinyl butyral alcohol solution, and the resulting solution was applied as a coating layer on a sheet of art paper with a wire bar thereby to produce an image-forming layer. A 5-percent vinyl chloride resin solution in toluene was applied on this image-forming layer, whereupon a photosensitive structure was obtained. This photosensitive structure was exposed to light from a xenon flash lamp (RISO TRAPEN' UP TU-207®, manufactured by Riso Kagaku Sha, Japan) having passed through a filter for cutting off visible and infrared rays and through a transmission original placed in direct contact with the surface of the photosensitive structure. As a result, an image wherein the light-exposed parts were colored was obtained.

The transmission original was then removed, and the entire surface of this photosensitive structure thus light-exposed was exposed to light from a xenon flash lamp passed through a filter for cutting off ultraviolet rays, whereupon an image wherein blue parts had blackened was obtained.

EXAMPLE 20

One part of a substance obtained from a reaction of isopropylamine and phosphomolybdic acid was dissolved in 5 parts of a 10-percent polyvinyl butyral alcohol solution and the resulting solution was applied as a coating on a polyester film with a wire bar, whereupon an image-forming layer was obtained. A 5-percent vinyl chloride resin THF solution was then applied as a coating on this image-forming layer, whereupon a photosensitive structure was obtained. With the use of this photosensitive structure, a black image was obtained by the procedure set forth in Example 13.

We claim:

1. An image-forming process which comprises (1) irradiating at least 100 mJ/cm$^2$ of imagewise ultraviolet rays an image-forming agent selected from the group consisting of polyacids of molybedenum and tungsten, alkali metal salts and ammonium salts of said polyacids and amine complexes and metal complexes of said polyacids, said image-forming agent being provided in layer form on at least one surface of a substrate and co-existing with a reducing agent, thereby to cause the same to undergo reduction and coloring in the form of the image, (2) irradiating the entire expanse of the image-forming agent surface thus obtained including colored parts and yet uncolored parts with long wavelength light rays which are absorbable by only the colored parts thereby to form a colored image wherein only the colored parts selectively have remarkably increased optical densities, and (3) contacting residual image-forming agent remaining in non-image parts with an alkaline substance whereby said image-forming agent is caused to lose its image-forming capability.

2. An image-forming process as claimed in claim 1 in which the layer of the image-forming agent contains the reducing agent.

3. An image-forming process as claimed in claim 1 in which the substrate is made of paper which also acts as the reducing agent.

4. An image-forming process as claimed in claim 1 in which the image-forming agent is at least one member selected from the group consisting of molybdic acid, sodium molybdate, ammonium molybdate, phosphomolybdic acid, ammonium phosphomolybdate, silicomolybdic acid, ammonium silicomolybdate, silicomolybdic acid, ammonium silicomolybdate, arsenomolybdic acid, ammonium arsenomolybdate, sodium arsenomolybdate, tungstic acid, ammonium tungstate, phosphotungstic acid, ammonium phosphotungstate, silicotungstic acid, ammonium silicotungstate, sodium silicotungstate, arsenotungstic acid, ammonium arsenotungstate, sodium arsenotungstate, isopropylammonium molybdate, and phosphovanadomolybdic acid.

5. An image-forming process as claimed in claim 1 in which the reducing agent is a member selected from the group consisting of D-glucose and reducing polymer compounds.

6. An image-forming process as claimed in claim 1 in which the image-forming agent layer contains a binder.

7. An image-forming process as claimed in claim 1 in which the image-forming agent surface after the coloring is irradiated with more than 2.5 J/cm$^2$ of long wavelength light rays.

8. An image-forming process as claimed in claim 1 in which the layer of the image-forming agent has a thickness of the order of 2 to 20 microns.

9. An image-forming process as claimed in claim 6 in which the binder is selected from the group consisting of polyvinyl alcohol, polyvinyl acetate, polyvinyl butyrals and cellulose esters.

10. An image-forming process as claimed in claim 6 in which the binder is present at a concentration of 10 to 60% by weight, and the image-forming agent is present at a concentration of not less than 15% by weight, both in the layer of the film-forming agent.

11. An image-forming process as claimed in claim 1 in which said image-wise ultraviolet rays are produced by passing light-rays including ultraviolet rays through a transmission original, and said long wavelength light rays are produced by passing light-rays including visible and/or infrared rays through a filter for cutting off ultraviolet rays.

12. An image-forming process according to claim 1 which said alkaline substance is ammonia.

* * * * *